US006604767B1

(12) United States Patent
Daniels

(10) Patent No.: US 6,604,767 B1
(45) Date of Patent: Aug. 12, 2003

(54) BALL RETRIEVAL SYSTEM

(76) Inventor: Vincent L. Daniels, 8491 Finch Ave. E, Jacksonville, FL (US) 32219

( * ) Notice: Subject to any disclaimer, the term of this patent is extended or adjusted under 35 U.S.C. 154(b) by 0 days.

(21) Appl. No.: 10/195,074

(22) Filed: Jul. 12, 2002

(51) Int. Cl.[7] ..... A63B 47/02
(52) U.S. Cl. ..... 294/19.2
(58) Field of Search ..... 294/19.2; 56/328.1, 56/332–336; 206/315.9; 473/207, 517

(56) References Cited

U.S. PATENT DOCUMENTS 2,516,622 A * 7/1950 George ..... 56/328.1
2,706,657 A * 4/1955 Talley ..... 294/19.2
3,117,814 A * 1/1964 Webb ..... 294/19.2
4,676,397 A 6/1987 Hoffmeister
5,086,948 A 2/1992 Slusarz
5,395,146 A 3/1995 Liu et al.
5,639,133 A 6/1997 Mote
5,975,600 A 11/1999 Hwang
5,988,716 A * 11/1999 Liao ..... 294/19.2
D436,722 S 1/2001 Larko

* cited by examiner

*Primary Examiner*—Dean J. Kramer

(57) ABSTRACT

A ball retrieval system includes a bag member that has a bottom wall. The bag member has a perimeter wall that extends upwardly from a perimeter edge of the bottom wall. The bag member has a top wall that is coupled to a distal end of the perimeter wall. The bag member defines an interior space. The bag member has an aperture that extends through the perimeter wall. The bag member is for holding a plurality of balls. A tube assembly is substantially hollow. The tube assembly has a proximal end coupled to the bag member abutting the aperture such that an interior of the tube assembly begin in environmental communication with the interior space of the bag member. The tube assembly has a distal end designed for receiving balls. The balls are movable through the tube assembly into the bag member.

15 Claims, 3 Drawing Sheets

BALL RETRIEVAL SYSTEM

BACKGROUND OF THE INVENTION

1. Field of the Invention

The present invention relates to retrieving and dispensing devices and more particularly pertains to a new ball retrieval system for providing a user with a new device that would make the act of collecting a large number of golf balls an easy task when a golfer is practicing his or her swing.

2. Description of the Prior Art

The use of retrieving and dispensing devices is known in the prior art. U.S. Pat. No. 5,975,600 describes a golf ball retrieving device and dispensing device for retrieving golf balls. Another type of retrieving and dispensing device is U.S. Pat. No. 5,639,133 having a ergonomic ball retriever and dispenser for retrieving and dispensing golf balls. U.S. Pat. No. 4,676,397 describes a golf ball dispenser for use by an individual on a practice tee or similar surface for the convenient placement of golf balls on a practice tee and the retrieval of golf balls on and around a practice tee. U.S. Pat. No. 5,395,146 describes a golf ball pickup device whereby golf balls are picked up therein and can be easily dispensed as desired. U.S. Pat. No. 5,086,948 describes a tennis ball pack dispensing and retrieving apparatus for dispensing and retrieving tennis balls. U.S. Pat. No. Des. 436,722 describes an ornamental design for a backpack golf caddy.

SUMMARY OF THE INVENTION

The object of the present invention is to provide a new ball retrieval system that would allow the golfer to pickup and collect golf balls without bending over.

Another object of the present invention is to provide a new ball retrieval system that using this new device in conjunction with a backyard golf net or mat would eliminate the time and cost associated with going to a driving range and would thus allow for convenient practice on a golfer's home property.

To this end, the present invention generally comprises a bag member that has a bottom wall. The bag member has a perimeter wall that extends upwardly from a perimeter edge of the bottom wall. The bag member has a top wall that is coupled to a distal end of the perimeter wall. The bag member defines an interior space. The bag member has an aperture that extends through the perimeter wall. The bag member is for holding a plurality of balls. A tube assembly is substantially hollow. The tube assembly has a proximal end coupled to the bag member abutting the aperture such that an interior of the tube assembly begin in environmental communication with the interior space of the bag member. The tube assembly has a distal end designed for receiving balls. The balls are movable through the tube assembly into the bag member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
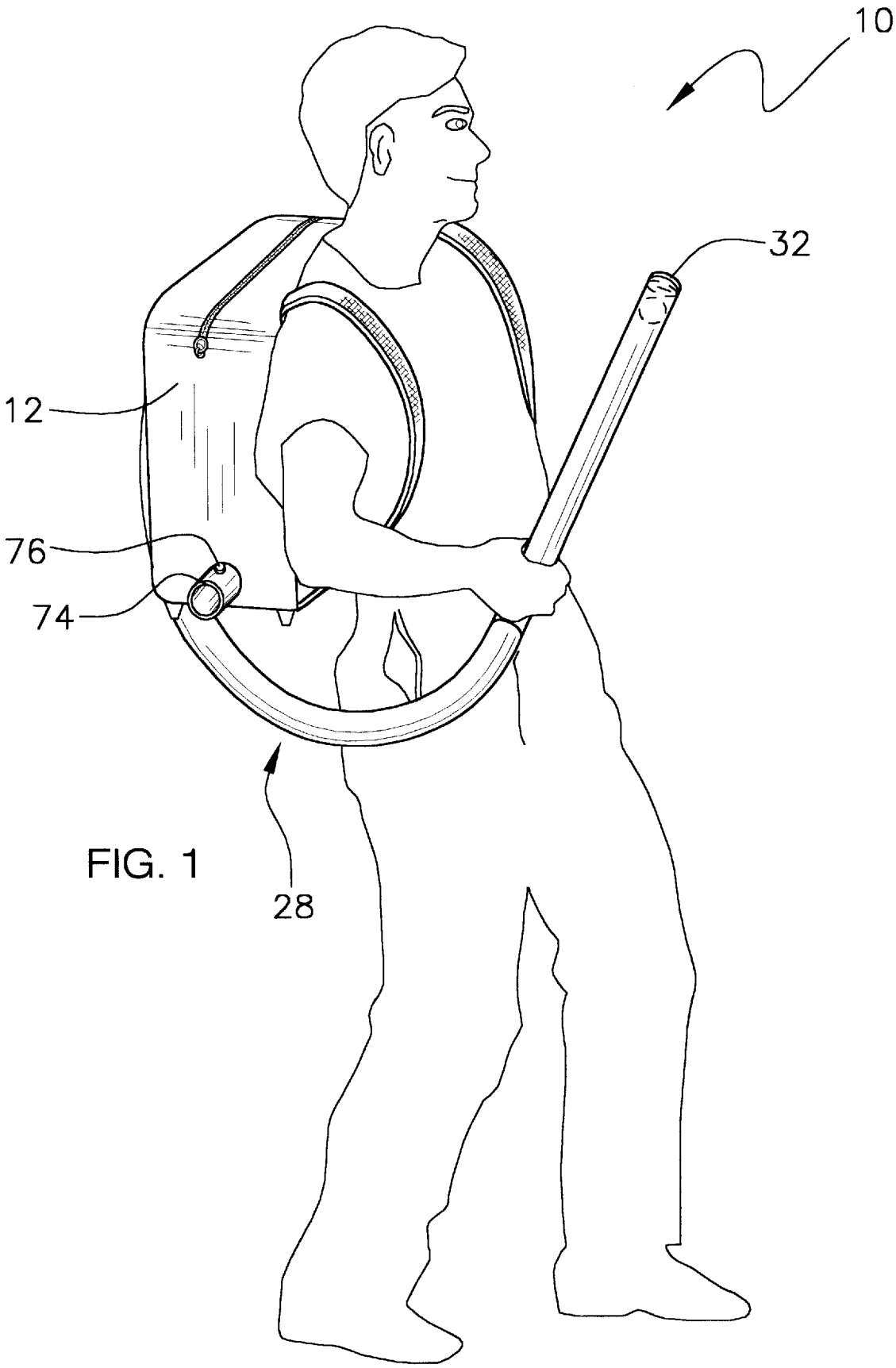
FIG. 1 is a in-use view of a new ball retrieval system according to the present invention.
Figure 2:
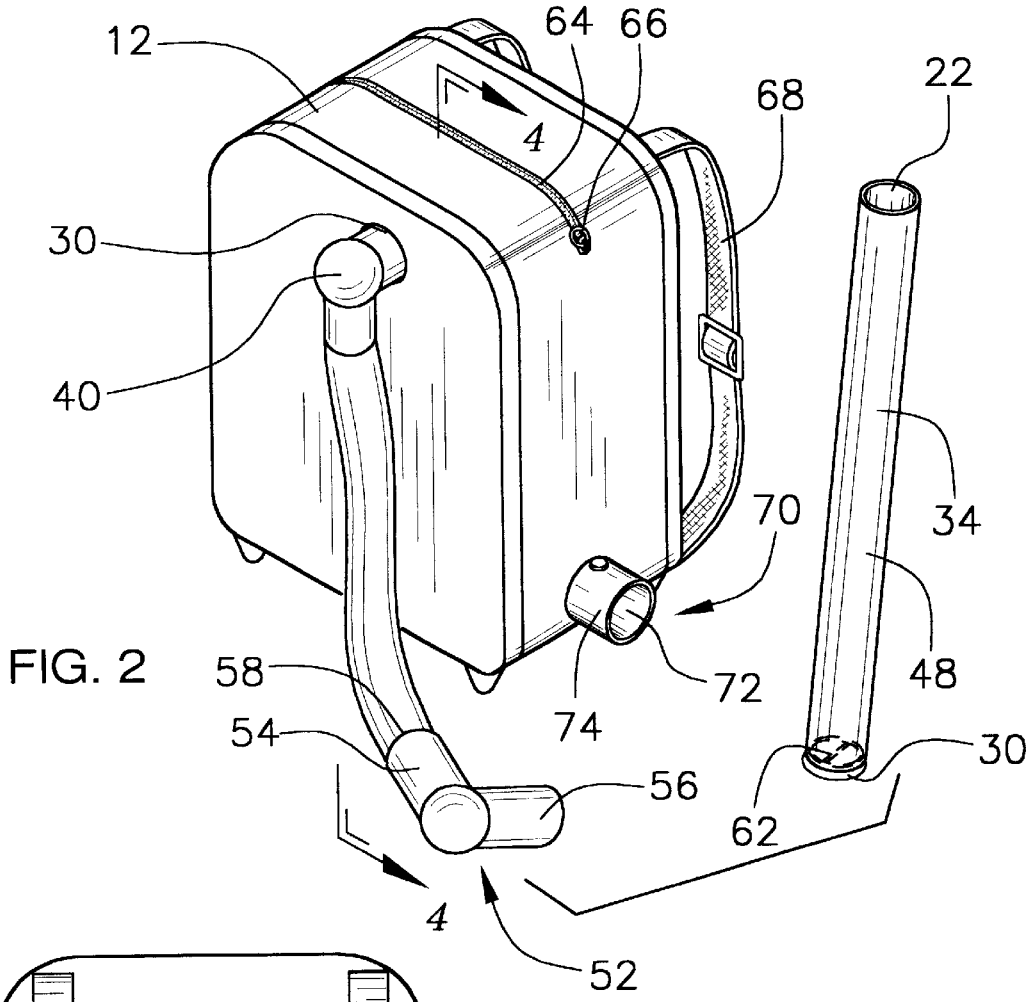
FIG. 2 is a perspective view of the present invention.
Figure 3:
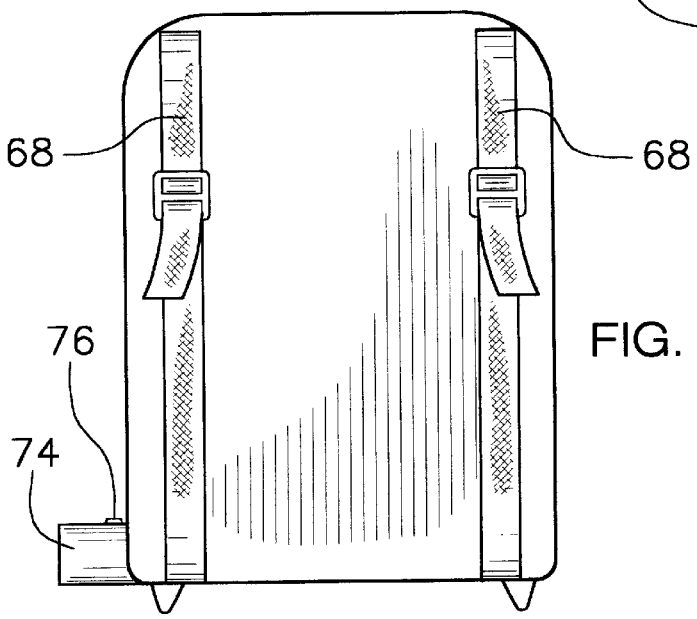
FIG. 3 is a rear view of the present invention.
Figure 4:
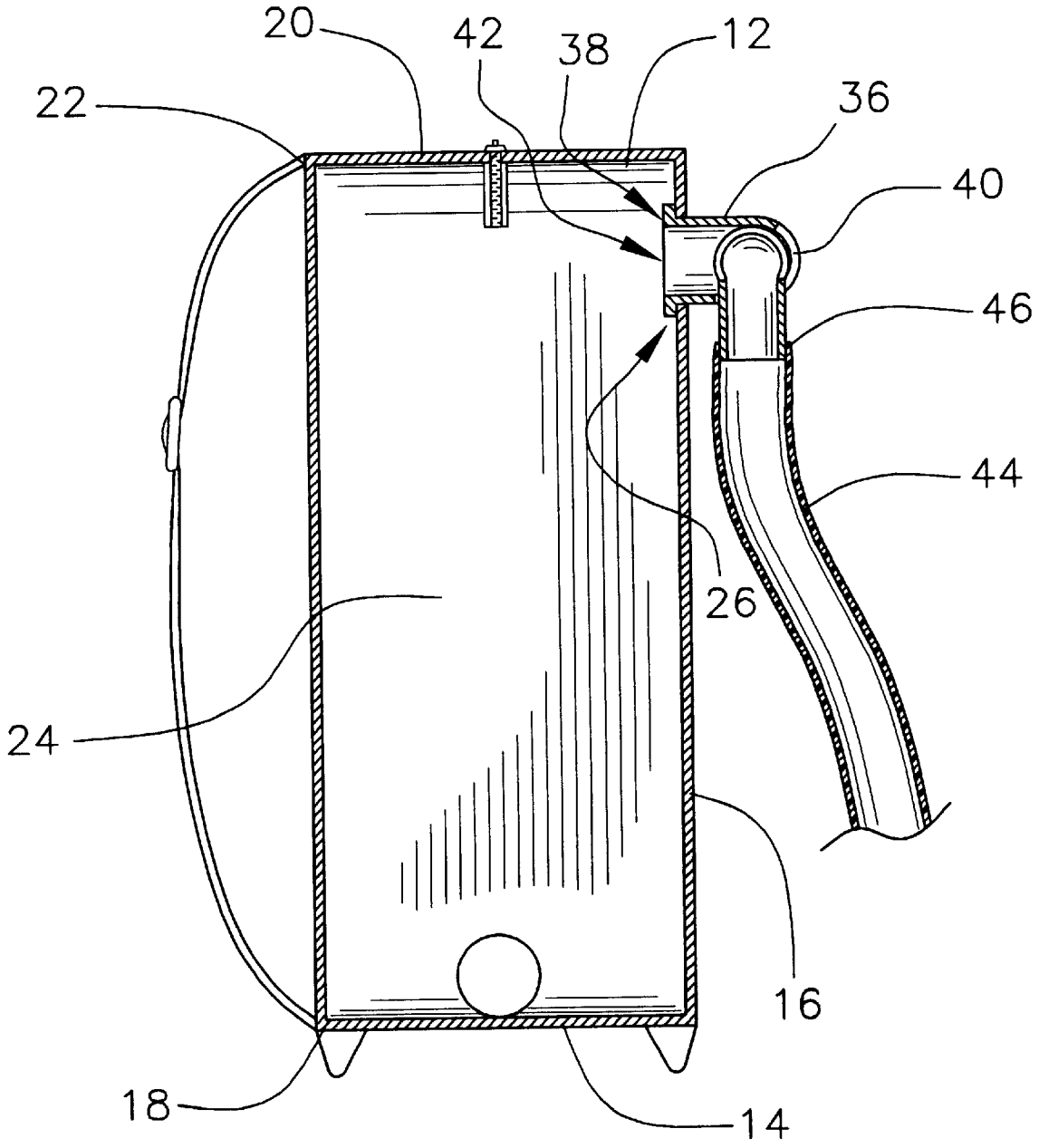
FIG. 4 is a cross-sectional view of the present invention.

With reference now to the drawings, and in particular to FIGS. 1 through 4 thereof, a new ball retrieval system embodying the principles and concepts of the present invention and generally designated by the reference numeral 10 will be described.

As best illustrated in FIGS. 1 through 4, the ball retrieval system 10 generally comprises a bag member 12 that has a bottom wall 14. The bag member 12 has a perimeter wall 16 that extends upwardly from a perimeter edge 18 of the bottom wall 14. The bag member 12 has a top wall 20 that is coupled to a distal end 22 of the perimeter wall 16. The bag member 12 defines an interior space 24. The bag member 12 has an aperture 26 that extends through the perimeter wall 16. The bag member 12 is for holding a plurality of balls. A tube assembly 28 is substantially hollow. The tube assembly 28 has a proximal end 30 coupled to the bag member 12 abutting the aperture 26 such that an interior of the tube assembly 28 being in environmental communication with the interior space 24 of the bag member 12. The tube assembly 28 has a distal end 32 designed for receiving balls. The balls are movable through the tube assembly into the bag member 12.

A tube member 34 is designed for receiving the balls. The tube member 34 has a proximal end 30 and a distal end 32. A connector member 36 has a flange portion 38 and a swivel portion 40. The flange portion 38 abuts an interior surface of the perimeter wall 16 adjacent to the aperture 26. The flange portion 38 has a bore 42 that extends therethrough. The bore 42 is aligned with the aperture 26. The flange portion 38 couples the tube assembly 28 to the bag member 12. The swivel portion 40 is operationally coupled to the connector member 36. The swivel portion 40 is substantially hollow. The swivel portion 40 is operationally coupled to the proximal end 30 of the tube member 34. The swivel portion 40 facilitates positioning of the tube member 34 radially referenced to the flange portion 38.

A first tube portion 44 has a proximal end 46 coupled to the swivel portion 40. The first tube portion 44 is flexible for facilitating positioning of the first tube portion 44. A second tube portion 48 has a distal end 30 designed for receiving balls. The second tube portion 48 is flexible for facilitating positioning of the second tube portion 48.

A joint assembly 52 has a first portion 54 and a second portion 56. The first portion 54 is coupled to a distal end 58 of the first tube portion 44. The second portion 56 is coupled to a proximal end 22 of the second tube portion 48. The joint assembly 52 is substantially hollow. The joint assembly 52 is an articulation point for the tube member 34. The joint assembly 52 environmentally couples the first tube portion 44 to the second tube portion 48.

A retaining means 62 is positioned within the distal end 30 of the tube member 34. The retaining means 62 is for allowing a ball to enter the distal end 30 of the tube member 34 while inhibiting a ball from exiting out of the tube member 34 through the distal end 30.

The bag member 12 further includes a slit 64 positioned in the top wall 20. The slit 64 provides access for a user into the interior space 24 of the bag member 12. A closure means 66 is for selectively closing the slit 64 such that access into the interior space 24 is inhibited such that the balls do not roll out of the slit 64. The bag member 12 further includes a pair of shoulder straps 68. Each one of the pair of shoulder straps 68 is positioned adjacent an associated side of the bag member 12. The pair of shoulder straps 68 facilitate carrying of the bag member 12 by a user.

A ball release assembly 70 is for selectively releasing balls from the interior space 24 of the bag member 12. The ball release assembly 70 is positioned adjacent to the bottom wall 14 of the bag member 12. A ball release aperture 72 extends through the perimeter wall 16 of the bag member 12. The ball release aperture 72 is adjacent to the bottom wall 14 of the bag member 12.

An exit tube portion 74 is coupled to the perimeter wall 16 surrounding the ball release aperture 72. The exit tube portion 74 is substantially hollow.

A ball release means 76 is positioned within the exit tube 74 the ball release means 76 is for selectively releasing a ball from the interior space 24 of the bag member 12 through the exit tube 74 to the user.

In use, after hitting numerous balls into and against the net or barrier, an individual would place this pack on his or her back, take the tube assembly in one hand, and begin picking up the balls, by pushing the end of the tube down onto the top of the balls, one after another, forcing them up the tube and into the back assembly. Preferably located inside the tip of the distal end of the tube is a type of spring mechanism, that allows the balls to enter and not fall out. The balls would roll through the tube member and through the tube assembly and then be deposited into the interior space of the bag member. Once the balls have been deposited, the user could simply depress the ball release means on the unit and dispense a ball for driving or chipping.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ball retrieval system for use in picking balls up from the ground, comprising:

a bag member having a bottom wall, said bag member having a perimeter wall extending upwardly from a perimeter edge of said bottom wall, said bag member having a top wall coupled to a distal end of said perimeter wall, said bag member defining an interior space, said bag member having an aperture extending through said perimeter wall, said bag member being for holding a plurality of balls;

a tube assembly being substantially hollow, said tube assembly having a proximal end coupled to said bag member abutting said aperture such the an interior of said tube assembly being in environmental communication with said interior space of said bag member, said tube assembly having a distal end adapted for receiving balls, the balls being movable through said tube assembly into said bag member;

wherein said tube assembly further comprises:

a tube member adapted of receiving the balls, said tube member having a proximal end and a distal end;

a connector portion having a flange portion and a swivel portion, said flange member abutting an interior surface of said perimeter wall adjacent to said aperture, said flange portion having a bore extending therethrough, said bore being aligned with said aperture, said flange portion being for coupling said tube assembly to said bag member;

said swivel portion being operationally coupled to said connector member, said swivel portion being substantially hollow, said swivel portion being operationally coupled to said proximal end of said tube member, said swivel portion facilitating positioning of said tube member radially referenced to said flange portion.

2. The system of claim 1, wherein said tube member further comprises:

a first tube portion having a proximal end coupled to said swivel portion, said first tube portion being flexible for facilitating positioning of said first tube portion;

a second tube portion having a distal end adapted for receiving balls, said second tube portion being flexible for facilitating positioning of said second tube portion; and a joint assembly having a first portion and a second portion, said first portion being coupled to a distal end of said first tube portion, said second portion being coupled to a proximal end of said second tube portion, said joint assembly being substantially hollow, said joint assembly being an articulation point for said tube member, said joint assembly environmentally coupling said first tube portion to said second tube portion.

3. The system of claim 1, further comprising a retaining means positioned within said distal end of said tube member, said retaining means being for allowing a ball to enter said distal end of said tube member while inhibiting a ball from exiting out of said tube member through said distal end.

4. The system of claim 1, wherein said bag member further comprises a slit positioned in said top wall, said slit providing access for a user into said interior space of said bag member.

5. The system of claim 4, further comprising a closure means for selectively closing said slit such that access into said interior space being inhibited such that the balls do not roll out of said slit.

6. The system of claim 1, wherein said bad member further comprises a pair of shoulder straps, each one of said pair of shoulder straps being positioned adjacent an associated of said bag member, said pair of shoulder straps facilitating carrying of said bag member by a user.

7. A ball retrieval system for use in picking balls up from the ground, comprising:

a bag member having a bottom wall, said bag member having a perimeter wall extending upwardly from a perimeter edge of said bottom wall, said bag member having a top wall coupled to a distal end of said perimeter wall, said bag member defining an interior space, said bag member being for holding a plurality of perimeter wall, said bag member being for holding a plurality of balls;

a tube assembly being substantially hollow, said tube assembly having a proximal end coupled to said bag member abutting said aperture such that an interior of said tube assembly being in environmental communication with said interior space of said bag member, said tube assembly having a distal end adapted for receiving balls, the balls being movable through said tube assembly into said bag member;

a tube member adapted for receiving the balls, said tube member having a proximal end and a distal end;

a connector member having a flange portion and a swivel portion, said flange portion abutting an interior surface of said perimeter wall adjacent to said aperture, said flange portion having a bore extending therethrough, said bore being aligned with said aperture, said flange portion being for coupling said tube assembly to said bag member;

said swivel portion being operationally coupled to said connector member, said swivel portion being substantially hollow, said swivel portion being operationally coupled to said proximal end of said tube member, said swivel portion facilitating positioning of said tube member radially referenced to said flange portion;

a first tube portion having a proximal end coupled to said swivel portion, said first tube portion being flexible for facilitating positioning of said first tube portion;

a second tube portion having a distal end adapted for receiving balls, said second tube portion being flexible for facilitating positioning of said second tube portion; and a joint assembly having a first portion and a second portion, said first portion being coupled to a distal end of said first tube portion, said second portion being coupled to a proximal end of said second tube portion, said joint assembly being substantially hollow, said joint assembly being an articulation point for said tube member, said joint assembly environmentally coupling said first tube portion to said second tube portion;

a retaining means positioned within said distal end of said tube member said retaining means being for allowing a ball to enter said distal end of said tube member while inhibiting a ball from exiting out of said tube member through said distal end;

wherein said bag member further comprises a slit positioned in said top wall, said slit providing access for a user into said interior space of said bag member;

a closure means for selectively closing said slit such that access into said interior space being inhibited such that the balls do not roll out of said slit;

wherein said bag member further comprises a pair of shoulder straps, each one of said pair of shoulder straps being positioned adjacent an associated side of said bag member, said pair of shoulder straps facilitating carrying of said bag member by a user;

a ball release assembly for selectively releasing balls from said interior space of said bag member, said ball release assembly being positioned adjacent to said bottom wall of said bag member; and a ball release aperture extending through said perimeter wall of said bag member, said ball release aperture being adjacent to said bottom wall of said bag member;

an exit tube portion coupled to said perimeter wall surrounding said ball release aperture, said exit tube portion being substantially hollow; and a ball release means positioned within said exit tube said ball release means being for selectively releasing a ball from said interior space of said bag member through said exit tube to the user.

8. A ball retrieval system for use in picking balls up from the ground, comprising:

a bag member having a bottom wall, said bag member having a perimeter wall extending upwardly from a perimeter edge of said bottom wall, said bag member having a top wall coupled to a distal end of said perimeter wall, said bag member defining an interior space, said bag member having an aperture extending through said perimeter wall, said bag member being for holding a plurality of balls;

a tube assembly being substantially hollow, said tube assembly having a proximal end coupled to said bag member abutting said aperture such that an interior of said tube assembly being in environmental communication with said interior space of said bag member, said tube assembly having a distal end adapted for receiving balls, the balls being movable through said tube assembly into said bag member; and a ball release assembly for selectively releasing balls from said interior space of said member, said ball release assembly being positioned adjacent to said bottom wall of said bag member.

9. The system of claim 8, further comprising:

a ball release aperture extending through said perimeter wall of said bag member, said ball release aperture being adjacent to said bottom wall of said bag member;

an exit tube portion coupled to said perimeter wall surrounding said ball release aperture, said exit tube portion being substantially hollow; and a ball release means positioned within said exit tube said ball release means being of selectively releasing a ball from said interior space of said bag member through said exit tube to the user.

10. The system of claim 8, wherein said tube assembly further comprises:

a tube member adapted for receiving the balls, said tube member having a proximal end and a distal end;

a connector member having a flange portion and a swivel portion, a flange portion abutting an interior surface of said perimeter wall adjacent to said aperture, said flange portion having a bore extending therethrough, said bore being aligned with said aperture, said flange portion being for coupling said tube assembly to said bag member;

said swivel portion being operationally coupled to said connector member, said swivel portion being substantially hollow, said swivel portion being operationally coupled to said proximal end of said tube member, said swivel portion facilitating positioning of said tube member radially referenced to said flange portion.

11. The system of claim 10, wherein said tube member further comprises:

a first tube portion having a proximal end coupled to said swivel portion, said first tube portion being flexible for facilitating positioning of said first tube portion;

a second tube portion having a distal end adapted for receiving balls, said second tube portion being flexible for facilitating positioning of said second tube portion; and a joint assembly having a first portion and a second portion, said first portion being coupled to a distal end of said first tube portion, said second portion being coupled to a proximal end of said second tube portion, said joint assembly being substantially hollow, said joint assembly being an articulation point for said tube member, said joint assembly environmentally coupling said first tube portion to said second tube portion.

12. The system of claim 8, further comprising a retaining means positioned within said distal end of a tube member said retaining means being for allowing a ball to enter said distal end of said tube member while inhibiting a ball from exiting out of said tube member through said distal end.

13. The system of claim 8, wherein said bag member further comprises a slit positioned in said top wall, said slit providing access for a user into said interior space of said bag member.

14. The system of claim 13 further comprising a closure means for selectively closing said slit such that access into said interior space being inhibited such that the balls do not roll out of said slit.

15. The system of claim 8, wherein said bag member further comprises a pair of shoulder straps, each one of said pair of shoulder straps being positioned adjacent an associated side of said bag member, said pair of shoulder straps facilitating carrying of said bag member by a user.

* * * * *